US011987419B2

(12) United States Patent
Boerman

(10) Patent No.: US 11,987,419 B2
(45) Date of Patent: May 21, 2024

(54) COLLAPSIBLE PALLET CASING ASSEMBLY AND USE THEREOF

(71) Applicant: NEFAB AB, Jönköping (SE)

(72) Inventor: Maarten Boerman, Eindhoven (NL)

(73) Assignee: NEFAB AB, Jönköping (SE)

( * ) Notice: Subject to any disclaimer, the term of this patent is extended or adjusted under 35 U.S.C. 154(b) by 283 days.

(21) Appl. No.: 17/606,158

(22) PCT Filed: May 15, 2019

(86) PCT No.: PCT/SE2019/050438
§ 371 (c)(1),
(2) Date: Oct. 25, 2021

(87) PCT Pub. No.: WO2020/231306
PCT Pub. Date: Nov. 19, 2020

(65) Prior Publication Data

US 2022/0194655 A1 Jun. 23, 2022

(51) Int. Cl.
*B65D 19/16* (2006.01)
*B65D 85/64* (2006.01)

(52) U.S. Cl.
CPC ..... *B65D 19/16* (2013.01); *B65D 85/64* (2013.01); *B65D 2519/00029* (2013.01); *B65D 2519/00064* (2013.01); *B65D 2519/00164* (2013.01); *B65D 2519/00169* (2013.01); *B65D 2519/00174* (2013.01); *B65D 2519/00273* (2013.01); *B65D 2519/00293* (2013.01);
(Continued)

(58) Field of Classification Search
CPC ..... B65D 19/16; B65D 85/64; B65D 2519/00029; B65D 2519/00064; B65D 2519/00164; B65D 2519/00169; B65D 2519/00174; B65D 2519/00273; B65D 2519/00293; B65D 2519/00323; B65D 2519/00333; B65D 2519/00502; B65D 2519/00592; B65D 2519/00611; B65D 2519/00646; B65D 2519/00661; B65D 2519/00721; B65D 2519/00925
USPC ..... 206/600
See application file for complete search history.

(56) References Cited

U.S. PATENT DOCUMENTS 5,253,763 A * 10/1993 Kirkley ..... B65D 19/16 206/600
7,669,718 B1 * 3/2010 Patty ..... A47F 5/108 206/600
2009/0014445 A1 * 1/2009 Hay ..... B65D 19/18 220/6

FOREIGN PATENT DOCUMENTS

CA 2404245 A1 3/2004
DE 4012871 A1 10/1991
(Continued)

*Primary Examiner* — Bryon P Gehman
(74) *Attorney, Agent, or Firm* — Dilworth & Barrese, LLP

(57) ABSTRACT

The invention relates to a collapsible pallet casing assembly (1), comprising a pallet (2) with a frame structure enclosing a loading surface thereof, a rear casing wall, a front casing wall (32) a top casing wall (15), as well as first (17) and second lateral casing walls. The assembly (1) is transferable between an erected state, in which it is used as a shipping crate for bulky objects, and a collapsed state in which it may be stored or transported as a unit claiming little space. The assembly (1) is transferable from the erected state to the collapsed state by folding all said casing walls (15, 17, 32) on top of each other onto the pallet (2). The invention also relates to use of such a pallet casing assembly (1) for shipping bulky objects, especially server racks or power cabinets.

19 Claims, 12 Drawing Sheets

(52) U.S. Cl.
CPC ..... *B65D 2519/00323* (2013.01); *B65D 2519/00333* (2013.01); *B65D 2519/00502* (2013.01); *B65D 2519/00592* (2013.01); *B65D 2519/00611* (2013.01); *B65D 2519/00646* (2013.01); *B65D 2519/00661* (2013.01); *B65D 2519/00721* (2013.01); *B65D 2519/00925* (2013.01)

(56) References Cited

FOREIGN PATENT DOCUMENTS

| | | | |
|---|---|---|---|
| EP | 3208206 | A1 | 8/2017 |
| FR | 2551726 | A1 | 3/1985 |
| WO | 2008/122074 | A1 | 10/2008 |

* cited by examiner

COLLAPSIBLE PALLET CASING ASSEMBLY AND USE THEREOF

TECHNICAL FIELD OF THE INVENTION

The present invention relates to a pallet casing assembly to be used as a shipping crate for bulky objects, especially server racks and power cabinets, as well as use of such a pallet casing assembly.

A pallet casing assembly is in this disclosure to be interpreted as including a pallet and a casing structure arranged on the pallet for enclosing a loading space of the pallet casing assembly; in simple terms: a pallet provided with a box-like structure for protecting the goods to be transported on the pallet.

Hence, the invention relates to a pallet casing assembly which is intended to be used within the field of commercial logistics, such as for storing of bulky objects, especially tall objects, in a ware-house or transport thereof from a manufacturer to a store or an end customer. Such bulky objects may be a piece of furniture or a refrigerator, as a few examples. However, the invention relates especially to a pallet casing assembly to be used as a shipping crate for bulky objects in the form of server racks and power cabinets, which commonly have a height of more than 2 meters and may have a weight of up to 1500 kilograms, or even more. A pallet casing assembly to be used as a shipping crate for server racks may therefore be mentioned as a typical example without restricting the invention thereto.

BACKGROUND ART

There are two commonly used packaging solutions for server rack shipments.

A first is to place the server rack on a regular pallet, wrap it in plastic film and provide the outer corners thereof with corner protections of corrugated cardboard, wooden panels or the like, whereafter straps are attached to hold the corner protections in place and secure the server rack to the pallet. This packaging solution is cost-effective, but implies a risk that the server rack is damaged during the transport as the impact protection of the packaging is very limited and the environmental protection is basically non-existent. Furthermore, this packaging solution provides a very limited protection against theft.

A second is to use a pallet casing assembly consisting of a pallet as a base, which is provided with a bottom plate, walls and a lid of wooden boards, such as plywood boards; in other words a wooden box built on a pallet. Such a box is commonly provided with foam on the inside of the walls for enhancing the impact protection thereof. This type of packaging may provide an adequate protection for the server rack during transport. However, this packaging solution is expensive and non-environmentally friendly, as each pallet casing assembly is disposable, i.e. built for being used during one shipment of a server rack, whereafter the components of said assembly are disposed. The pallet casing assemblies of this type simply take up too much space for it to be possible to justify their reuse (which generally means they have to be transported back empty) from an economical perspective.

There is therefore a need for a pallet casing assembly to be used as a shipping crate for server racks which has a large loading space enclosed by a strong protective casing during use and which may be made small to occupy little space when being transported without load, so as to enable transportation thereof back to a server rack manufacturer or a logistics provider for reuse, at a low cost. Furthermore, such a pallet casing assembly should be quickly assembled before use as well as easily disassembled after use, so that handling time and thereby logistics costs are kept low.

SUMMARY OF THE INVENTION

The object of the present invention is to provide a pallet casing assembly of the type defined in the introduction being improved in at least some aspect with respect to such pallet casing assemblies already known.

This object is according to the invention obtained by providing a collapsible pallet casing assembly according to the description herein.

More specifically, the fact that

- the lower rear wall section has a width which is smaller than the distance between the first and second lateral frame walls,
- the first lateral end of the lower rear wall section is located at a distance from the first lateral frame wall in said erected state,
- the second lateral end of the lower rear wall section is located at a distance from the second lateral frame wall in said erected state,
- the lower first lateral wall section is hingedly connected to the first lateral end of the lower rear wall section by a first link element connected at a first end to the rear end of the lower first lateral wall section and pivotably connected at an opposite second end to the first lateral end of the lower rear wall section, so as to make the lower first lateral wall section pivotably movable between a position resting on the first lateral frame wall in said erected state, and a position displaced from the first lateral frame wall towards the second lateral frame wall so as to be receivable between the first and second lateral frame walls on the loading surface in said collapsed state, and
- the lower second lateral wall section is hingedly connected to the second lateral end of the lower rear wall section by a second link element connected at a first end to the rear end of the lower second lateral wall section and pivotably connected at an opposite second end to the second lateral end of the lower rear wall section, so as to make the lower second lateral wall section pivotably movable between a position resting on the second lateral frame wall in said erected state, and a position displaced from the second lateral frame wall towards the first lateral frame wall so as to be receivable between the first and second lateral frame walls on the loading surface in said collapsed state, provide the pallet casing assembly with a design which enables collapsing/folding thereof to a small compact unit in said collapsed state. Hence, the invention offers a collapsible pallet casing assembly which forms a well protective shipping crate for server racks in said erected state, and a small unit occupying little space in the collapsed state. Furthermore, the design of the pallet casing assembly enables easy and quick transfer, i.e. erecting/mounting and collapsing/demounting, of this between said states.

According to an embodiment of the invention the lower first lateral wall section comprises at least two plate members together constituting this wall section, wherein a first plate member is hingedly connected at a rear end to the lower rear wall section by the first link element, and a second plate member is hingedly connected at a rear end to a front end of this first plate member so as to be foldable to a position overlapping this first plate member to be placed between this first plate member of the lower first lateral wall section and the lower rear wall section in said collapsed state, and the lower second lateral wall section comprises at least two plate members together constituting this wall section, wherein a first plate member is hingedly connected at a rear end to the lower rear wall section by the second link element, and a second plate member is hingedly connected at a rear end to a front end of this first plate member so as to be foldable to a position overlapping this first plate member to be placed between this first plate member of the lower second lateral wall section and the first plate member of the lower first lateral wall section in said collapsed state. This design enables providing the pallet casing assembly with wider lateral walls and thereby a greater loading space in the erected state, without impairing the compactness thereof in the collapsed state.

According to another embodiment of the invention the first link element is configured to hold the first plate member of the lower first lateral wall section at a distance to the lower rear wall section corresponding to the thickness of the second plate member of the lower first lateral wall section in said collapsed state. The first plate member is thereby configured to be positioned in parallel with the lower rear wall section, with the second plate member sandwiched between them, in the collapsed state, which minimizes unused space between these wall sections and results in a stable structure of the pallet casing assembly in the collapsed state.

According to another embodiment of the invention the second link element is configured to hold the first plate member of the lower second lateral wall section at a distance to the lower rear wall section corresponding to the thicknesses of the second plate member of the lower first lateral wall section, the first plate member of the lower first lateral wall section and the second plate member of the lower second lateral wall section combined in said collapsed state. The first plate member of the lower second lateral wall section is thereby configured to be positioned in parallel with the lower rear wall section, with the first and second plate members of the lower first lateral wall section and the second plate member of the lower second lateral wall section sandwiched between them, in the collapsed state, which minimizes unused space between these wall sections and results in a stable structure of the pallet casing assembly in the collapsed state.

According to another embodiment of the invention the first link element is configured to extend in a plane in which the lower rear wall section extends in said erected state and to form a right-angled corner with the lower first lateral wall section in said erected state, and to extend perpendicularly away from the lower rear wall section in said collapsed state, and the second link element is configured to extend in the plane in which the lower rear wall section extends in said erected state and to form a right-angled corner with the lower second lateral wall section in said erected state, and to extend perpendicularly away from the lower rear wall section in said collapsed state.

According to another embodiment of the invention the first link element is rigidly connected at the first end thereof to the rear end of the lower first lateral wall section and the second link element is rigidly connected at the first end thereof to the rear end of the lower second lateral wall section.

According to another embodiment of the invention the lower rear wall section has a height which is lower than the height of the lower first and second lateral wall sections, and the upper rear wall section is provided with a first corner rim extending from a first lateral edge of the upper rear wall section to cover, from the outside, at least a part of a rear end of the upper first lateral wall section and a part of the rear end of the lower first lateral wall section in said erected state, and a second corner rim extending from a second lateral edge of the upper rear wall section to cover, from the outside, at least a part of a rear end of the upper second lateral wall section and a part of the rear end of the lower second lateral wall section in said erected state. This design of said wall sections in combination with said corner rims makes the pallet casing assembly stable in the erected state. Furthermore, the corner rims imply a simple mounting of the upper wall sections on top of the lower wall sections as they keep the upper first and second lateral wall sections aligned with the lower first and second lateral wall sections, respectively, during a mounting step of placing the upper lateral wall sections to rest on the lower lateral wall sections.

According to another embodiment of the invention the upper first lateral wall section is hingedly connected at the upper end to the first lateral end of the top wall section by a third link element connected at a first end to the upper end of the upper first lateral wall section and pivotably connected at an opposite second end to the first lateral end of the top wall section, wherein the third link element is configured to enable folding of the upper first lateral wall section to a position overlapping and extending in parallel with the top wall section in said collapsed state.

According to another embodiment of the invention the upper second lateral wall section is hingedly connected at the upper end to the second lateral end of the top wall section by a fourth link element connected at a first end to the upper end of the upper second lateral wall section and pivotably connected at an opposite second end to the second lateral end of the top wall section, wherein the fourth link element is configured to enable folding of the upper second lateral wall section to a position overlapping and extending in parallel with the upper first lateral wall section in said collapsed state, and to hold the upper second lateral wall section at a distance from the top wall section corresponding to the length of the third link element in said collapsed state. The upper second lateral wall section is thereby configured to be positioned in parallel with the top wall section, with the upper first lateral wall section sandwiched between them, in the collapsed state, which minimizes unused space between these wall sections and results in a stable structure of the pallet casing assembly in the collapsed state.

According to another embodiment of the invention the third link element is configured to extend in a plane in which the top wall section extends in said erected state and to form a right-angled corner with the upper first lateral wall section in said erected state, and to extend perpendicularly away from the top wall section in said collapsed state, and the fourth link element is configured to extend in the plane in which the top wall section extends in said erected state and to form a right-angled corner with the upper second lateral wall section in said erected state, and to extend perpendicularly away from the top wall section in said collapsed state.

According to another embodiment of the invention the third link element is rigidly connected at the first end thereof to the upper end of the upper first lateral wall section and the fourth link element is rigidly connected at the first end thereof to the upper end of the upper second lateral wall section.

According to another embodiment of the invention the assembly further comprises:

a front casing wall configured to be releasably arranged at a front side of the pallet so as to close a front opening into a loading space of the pallet casing assembly in said erected state, and placed in a position on top of the loading surface between this and the lower second lateral wall section in said collapsed state.

According to another embodiment of the invention the front casing wall comprises a lower front wall section and an upper front wall section hingedly connected at a lower end to an upper end of the lower front wall section so as to be foldable to a position overlapping the lower front wall section to be placed on top of or under the lower front wall section between the loading surface and the lower second lateral wall section in said collapsed state. This design of the front casing wall makes it fit on the loading surface without any part of said wall protruding out past the periphery of the pallet in said collapsed state, which makes the pallet casing assembly a single small unit in said collapsed state.

According to another embodiment of the invention the pallet casing assembly has a height of at least 1.5 meters, preferably between 2.0 and 2.5 meters, in said erected state, and a height lower than 0.5 meters in said collapsed state.

According to another embodiment of the invention the upper first lateral wall section, the upper second lateral wall section and the top wall section have surface areas equal to, or at least substantially equal to, the surface area of the loading surface, and the lower first lateral wall section and the lower second lateral wall section have surface areas which are greater than the surface area of the loading surface.

According to another embodiment of the invention the loading space of the pallet casing assembly is completely closed in said erected state.

According to another embodiment of the invention the loading space of the pallet casing assembly has a height, from the loading surface to the top casing wall, of at least 2.0 meters, preferably between 2.0 and 2.5 meters, in the erected state.

According to another embodiment of the invention the pallet has standard dimensions as defined by EUR, ISO or GMA.

The invention also relates to use of a collapsible pallet casing assembly for shipping a bulky object, especially a server rack. Realizations of, and advantages with, such a use clearly appears from the above and following description of embodiments of a collapsible pallet casing assembly according to the invention.

Further advantages as well as advantageous features of the invention will appear from the following description of an embodiment of the invention.

BRIEF DESCRIPTION OF THE DRAWINGS

With reference to the appended drawings, below follows a specific description of an embodiment of the invention cited as an example.

In the drawings.

DETAILED DESCRIPTION OF AN EMBODIMENT OF THE INVENTION

A collapsible pallet casing assembly 1 configured to be used as a shipping crate for bulky objects, especially server racks, according to an embodiment of the invention is illustrated in the appended FIGS. 1-18 and will now be described while at the same time making reference to all these figures.

Figure 1:
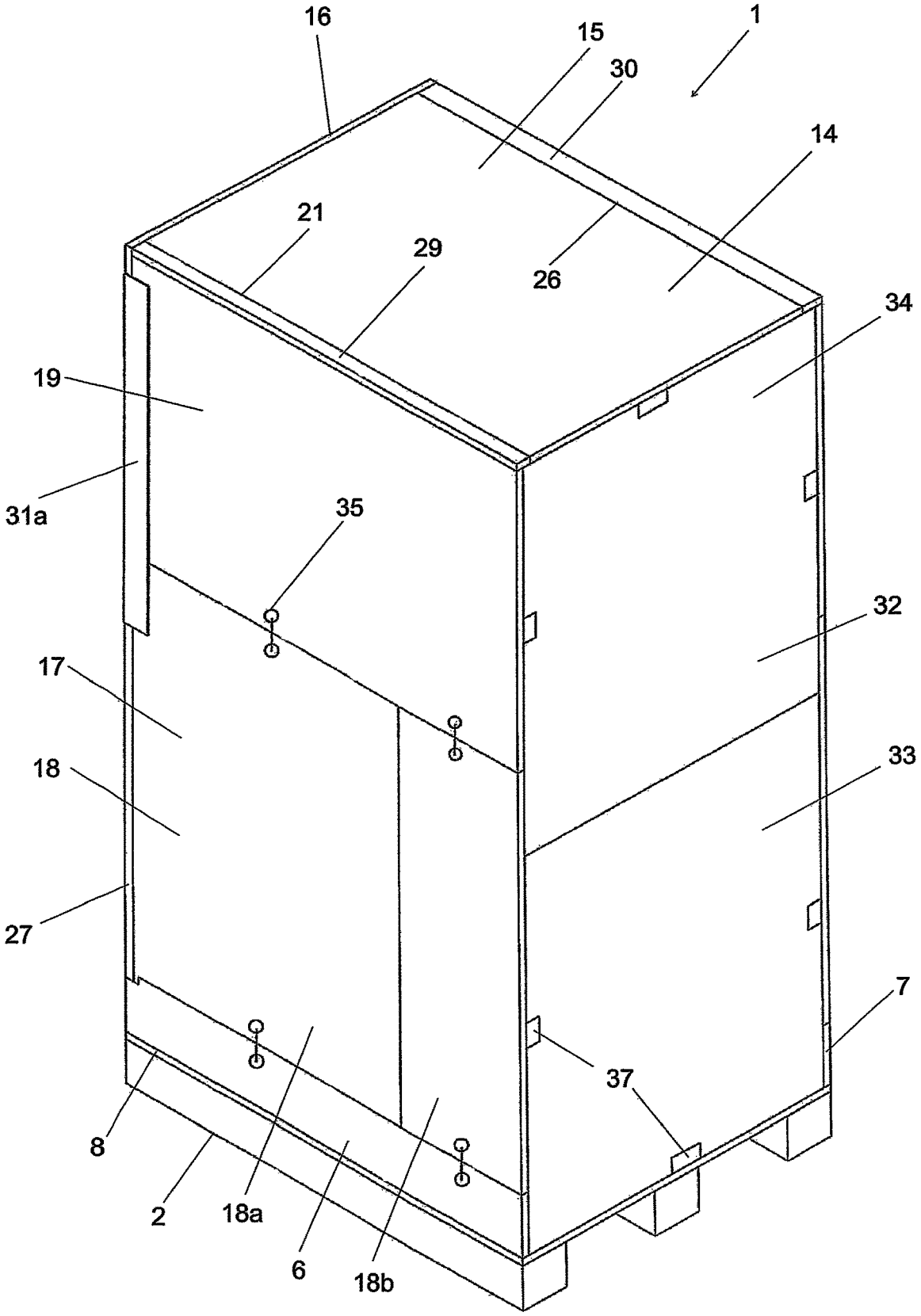
FIG. 1 is a simplified perspective view obliquely from the front of a collapsible pallet casing assembly according to the invention, in the erected state.
Figure 2:
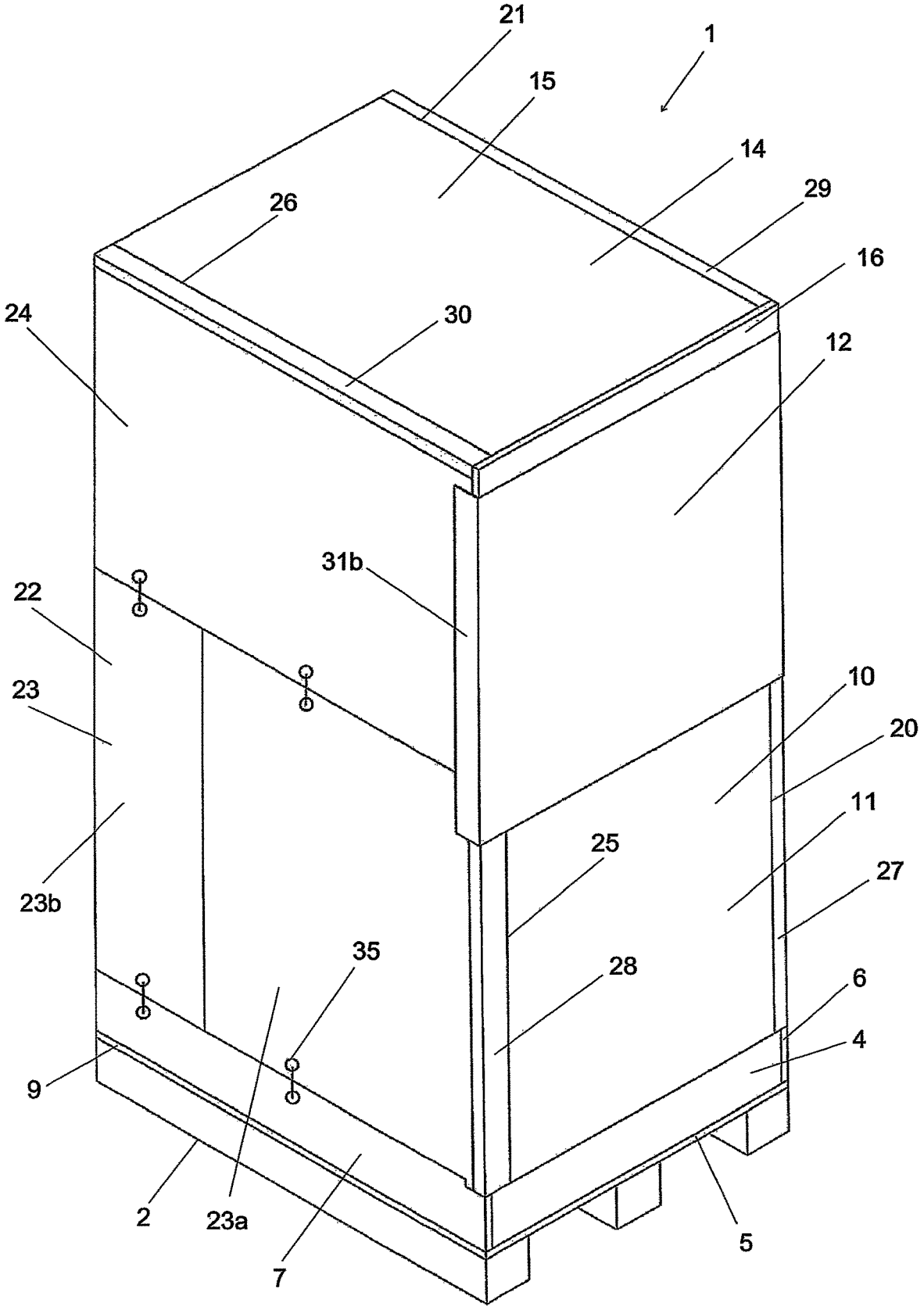
FIG. 2 is a perspective view obliquely from the back of the pallet casing assembly of FIG. 1.
Figure 3:
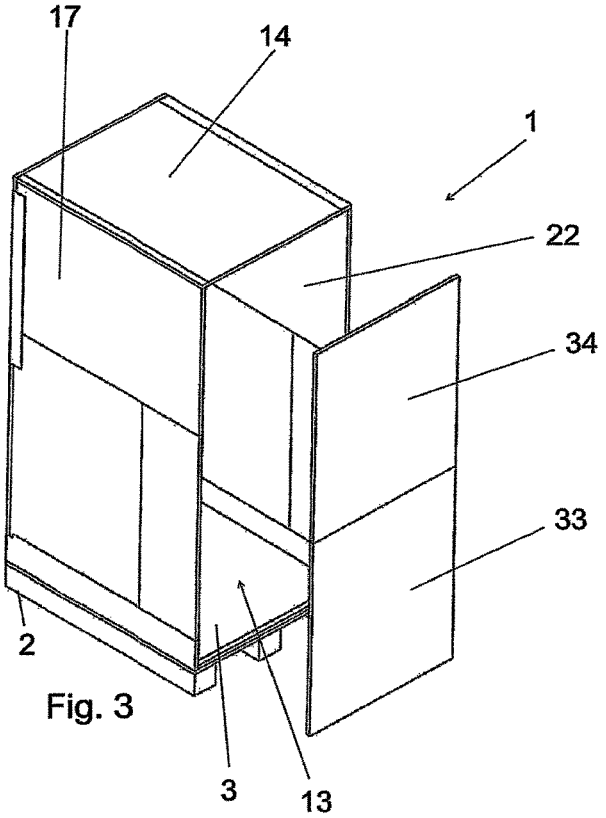
FIG. 3 is a view of the pallet casing assembly of FIG. 1 during a first step of a collapsing process, i.e. a process of transferring the pallet casing assembly from the erected state to the collapsed state.
Figure 4:
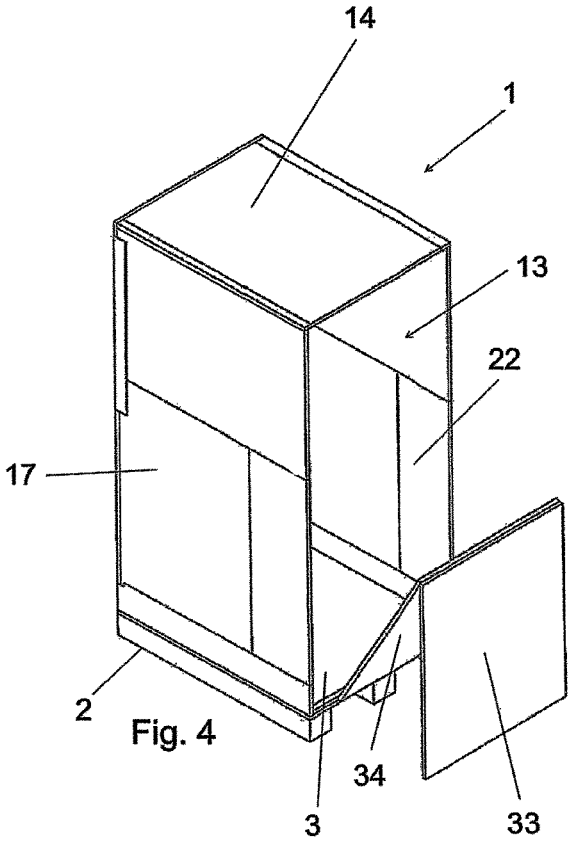
FIG. 4 is a view of the pallet casing assembly of FIG. 1 during a second step of a collapsing process.

The pallet casing assembly 1 comprises a pallet 2, such as a standard wooden EUR-pallet, provided with an upper loading surface 3, for instance formed by a wooden board or other sheet material, configured to form a bottom of the pallet casing assembly in an erected state thereof (see FIGS. 1 and 2). More specifically, the upper loading surface 3 constitutes a bottom of an inner loading space 13 of the pallet casing assembly in said erected state. The pallet 2 is provided with a frame structure enclosing the loading surface 3 on a rear side and lateral sides thereof in the manner of a pallet collar with open front. The frame structure comprises a vertical rear frame wall 4 extending at and along a rear edge 5 of the pallet, and vertical first 6 and second 7 lateral frame walls extending at and along first 8 and second 9 opposite lateral edges of the pallet, respectively.

The pallet casing assembly 1 further comprises a rear casing wall 10, a top casing wall 14, a first lateral casing wall 17, a second lateral casing wall 22 and a front casing wall 32 together forming a box-like structure on the pallet 2 in the erected state of the pallet casing assembly so as to define and enclose the loading space 13 thereof.

The rear casing wall 10 comprises a lower rear wall section 11 and an upper rear wall section 12. The lower rear wall section 11 is hingedly connected at a lower end to the rear frame wall 4 so as to be foldable (see FIG. 12) to a position on top of the loading surface 3 in a collapsed state of the pallet casing assembly (see FIGS. 17-18). The upper rear wall section 12 is hingedly connected to an upper end of the lower rear wall section 11 so as to be foldable (see FIGS. 6 and 12) to a position on top of the lower rear wall section in said collapsed state.

The top casing wall 14 comprises a top wall section 15 hingedly connected at a rear end to an upper end of the upper rear wall section 12 by a rear edge rim 16 fixedly secured to the rear end of the top wall section 15 and hingedly secured to the upper end of the upper rear wall section 12, so that the top wall section 15 is foldable (see FIG. 16) to a position on top of the upper rear wall section 12 in the collapsed state.

The first lateral casing wall 17 comprises a lower first lateral wall section 18 and an upper first lateral wall section 19.

The lower first lateral wall section 18 is configured to rest on the first lateral frame wall 6 in said erected state and is hingedly connected at a rear end to a first lateral end 20 of the lower rear wall section 11 so as to be foldable (see FIG. 8) to a position overlapping, i.e. at least partly covering (see FIG. 10), the lower rear wall section to be placed (see FIG. 12) between the lower rear wall section and the loading surface 3 in said collapsed state. The lower first lateral wall section 18 comprises two plate members 18*a-b* together constituting this wall section, of which a first plate member 18*a* is hingedly connected at a rear end to the lower rear wall section 11, and a second plate member 18*b* is hingedly connected at a rear end to a front end of the first plate member 18*a* so as to be foldable (see FIG. 7) to a position overlapping this first plate member 18*a* to be placed (see FIGS. 8 and 12) between the first plate member 18*a* of the lower first lateral wall section 18 and the lower rear wall section 11 in said collapsed state.

The upper first lateral wall section 19 is configured to rest on an upper end of the lower first lateral wall section 18, i.e. on upper ends of the first 18*a* and second 18*b* plate members of the lower first lateral wall section, in said erected state. The upper first lateral wall section 19 is hingedly connected at an upper end to a first lateral end 21 of the top wall section 15 so as to be foldable (see FIG. 14) to a position overlapping the top wall section to be placed (see FIG. 16) between the top wall section 15 and the upper rear wall section 12 in said collapsed state.

The second lateral casing wall 22 has a corresponding structure as the first lateral casing wall 17 and comprises a lower second lateral wall section 23 and an upper second lateral wall section 24.

The lower second lateral wall section 23 is configured to rest on the second lateral frame wall 7 in said erected state and is hingedly connected at a rear end to a second lateral end 25 of the lower rear wall section 11 so as to be foldable (see FIGS. 9-10) to a position overlapping the lower first lateral wall section 18 to be placed (see FIG. 12) between the lower first lateral wall section and the loading surface 3 in said collapsed state. The lower second lateral wall section 23 comprises two plate members 23*a-b* together constituting this wall section, of which a first plate member 23*a* is hingedly connected at a rear end to the lower rear wall section 11 and a second plate member 23*b* is hingedly connected at a rear end to a front end of the first plate member 23*a* so as to be foldable (see FIG. 7) to a position overlapping this first plate member 23*a* to be placed (see FIGS. 9-10 and 12) between the first plate member 23*a* of the lower second lateral wall section 23 and the first plate member 18*a* of the lower first lateral wall section 18 in said collapsed state.

The upper second lateral wall section 24 is configured to rest on an upper end of the lower second lateral wall section 23, i.e. on upper ends of the first 23*a* and second 23*b* plate members of the lower second lateral wall section, in said erected state. The upper second lateral wall section 24 is hingedly connected at an upper end to a second lateral end 26 of the top wall section 15 so as to be foldable (see FIG. 15) to a position overlapping the upper first lateral wall section 19 to be placed (see FIG. 16) between the upper first lateral wall section 19 and the upper rear wall section 12 in said collapsed state.

The first 18*a*, 23*a* and second 18*b*, 23*b* plate members of the lower first 18 and second 23 lateral wall sections are releasably secured at lower ends thereof to the respective lateral frame walls 6, 7 and at upper ends thereof to lower ends of the upper first 19 and second 24 lateral wall sections in the erected state. Securing means 35 suitable for this purpose, such as clips, are therefore provided at suitable positions on these components. Such securing means are schematically shown in FIGS. 1 and 2. Furthermore, the upper first 19 and second 24 lateral wall sections are releasably secured to the upper rear wall section 12 in the erected state. Securing means 36 suitable for this purpose, such as clips or buttons, are therefore provided on these components, and schematically shown in FIGS. 13-16.

The lower rear wall section 11 has a width which is smaller than the distance between the first 6 and second 7 lateral frame walls, which is seen for instance in FIG. 2. The first lateral end 20 of the lower rear wall section is located at a distance from the first lateral frame wall 6, or from a plane in which this frame wall extends, (in a direction perpendicularly away from the first lateral frame wall 6 towards the second lateral frame wall 7) in said erected state and the second lateral end 25 of the lower rear wall section is located at a distance from the second lateral frame wall 7, or from a plane in which this frame wall extends, (in a direction perpendicularly away from the second lateral frame wall 7 towards the first lateral frame wall 6) in said erected state.

The lower first lateral wall section 18 is hingedly connected to the first lateral end 20 of the lower rear wall section 11 by a first link element 27. The first link element is rigidly connected, such as by screws, adhesive or welding, at a first end to the rear end of the lower first lateral wall section, and more specifically to the rear end of the first plate member 18*a* of the lower first lateral wall section, in such a way that it extends perpendicularly away from said first plate member 18*a*, and pivotably connected at an opposite second end to the first lateral end 20 of the lower rear wall section 11. The first link element 27 is configured to extend in a plane in which the lower rear wall section 11 extends in said erected state, so as to act as an extension of the lower rear wall section with the first end of the first link element in contact with the first lateral end 20 of the lower rear wall section 11 and the second end of the first link element resting upon the first lateral frame wall 6 in the erected state, and to form a right-angled corner with the lower first lateral wall section 18. The first link element 27 is configured to be pivotably moved with the first plate member 18*a* of the lower first lateral wall section 18 by folding this (see FIG. 8) so as to extend perpendicularly away from the lower rear wall section 11 in said collapsed state.

The first link element 27 is in this way configured to make the lower first lateral wall section 18 pivotably movable between a position resting on the first lateral frame wall 6 in said erected state, and a position displaced from the first lateral frame wall towards the second lateral frame wall 7 so as to be receivable between the first and second lateral frame walls on the loading surface 3 in said collapsed state.

In a corresponding way, the lower second lateral wall section 23 is hingedly connected to the second lateral end 25 of the lower rear wall section 11 by a second link element 28. The second link element is rigidly connected at a first end to the rear end of the lower second lateral wall section 23, and more specifically to the rear end of the first plate member 23*a* of the lower second lateral wall section, in such a way that it extends perpendicularly away from said first plate member 23*a*, and pivotably connected at an opposite second end to the second lateral end 25 of the lower rear wall section. The second link element 28 is configured to extend in the plane in which the lower rear wall section 11 extends in said erected state, so as to act as an extension of the lower rear wall section with the first end of the second link element in contact with the second lateral end 25 of the lower rear wall section 11 and the second end of the second link element resting upon the second lateral frame wall 7 in the erected state, and to form a right-angled corner with the lower second lateral wall section 23. The second link element 28 is configured to be pivotably moved with the first plate member 23*a* of the lower second lateral wall section 23 by folding this (see FIGS. 9-10) so as to extend perpendicularly away from the lower rear wall section 11 in said collapsed state.

The second link element 28 is in this way configured to make the lower second lateral wall section 23 pivotably movable between a position resting on the second lateral frame wall 7 in said erected state, and a position displaced from the second lateral frame wall towards the first lateral frame wall 6 so as to be receivable between the first and second lateral frame walls on the loading surface 3 in said collapsed state.

Figure 7:
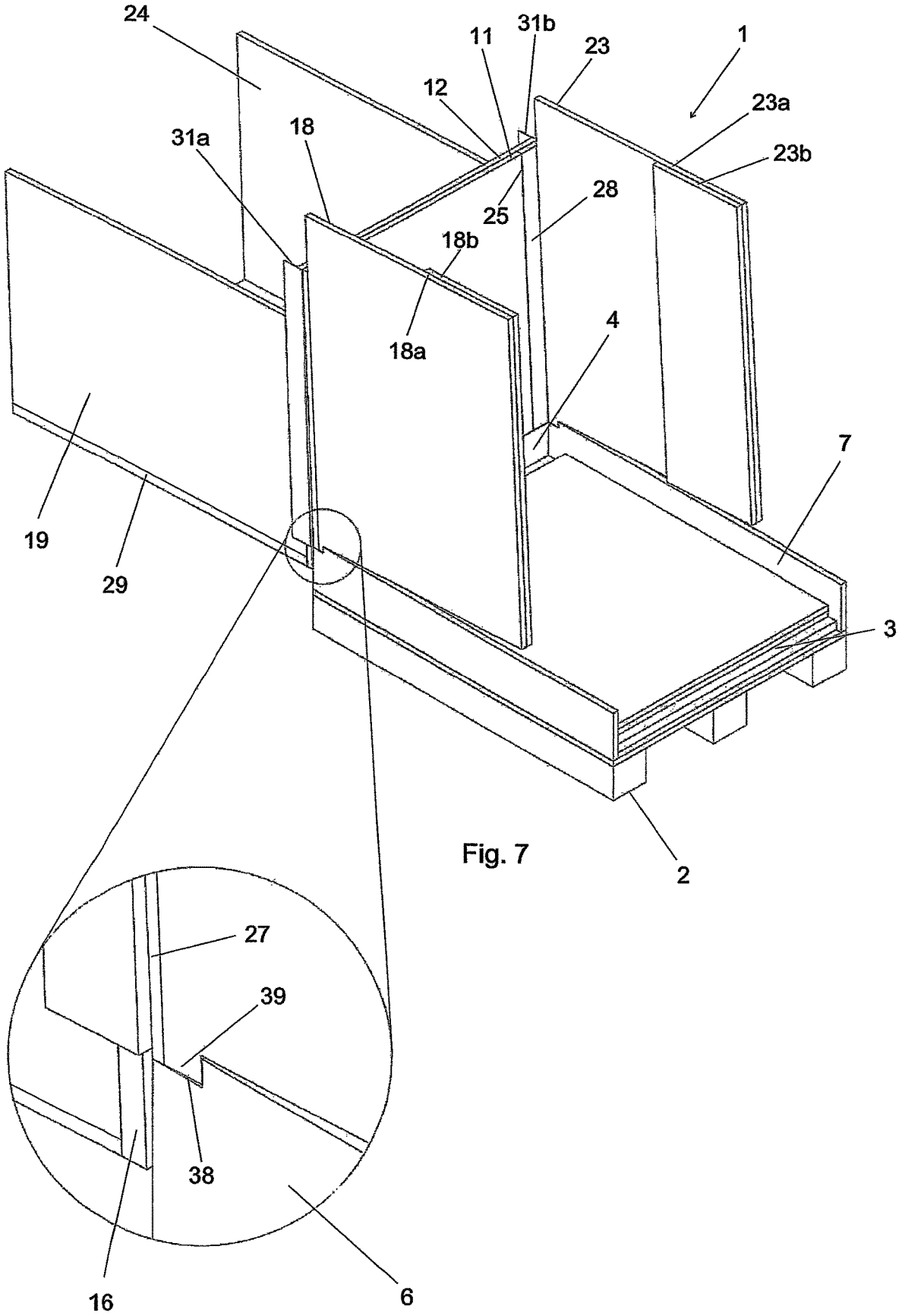
FIG. 7 is a view of the pallet casing assembly of FIG. 1 during a fifth step of a collapsing process, showing a part of the lower first lateral wall in detail.
Figure 8:
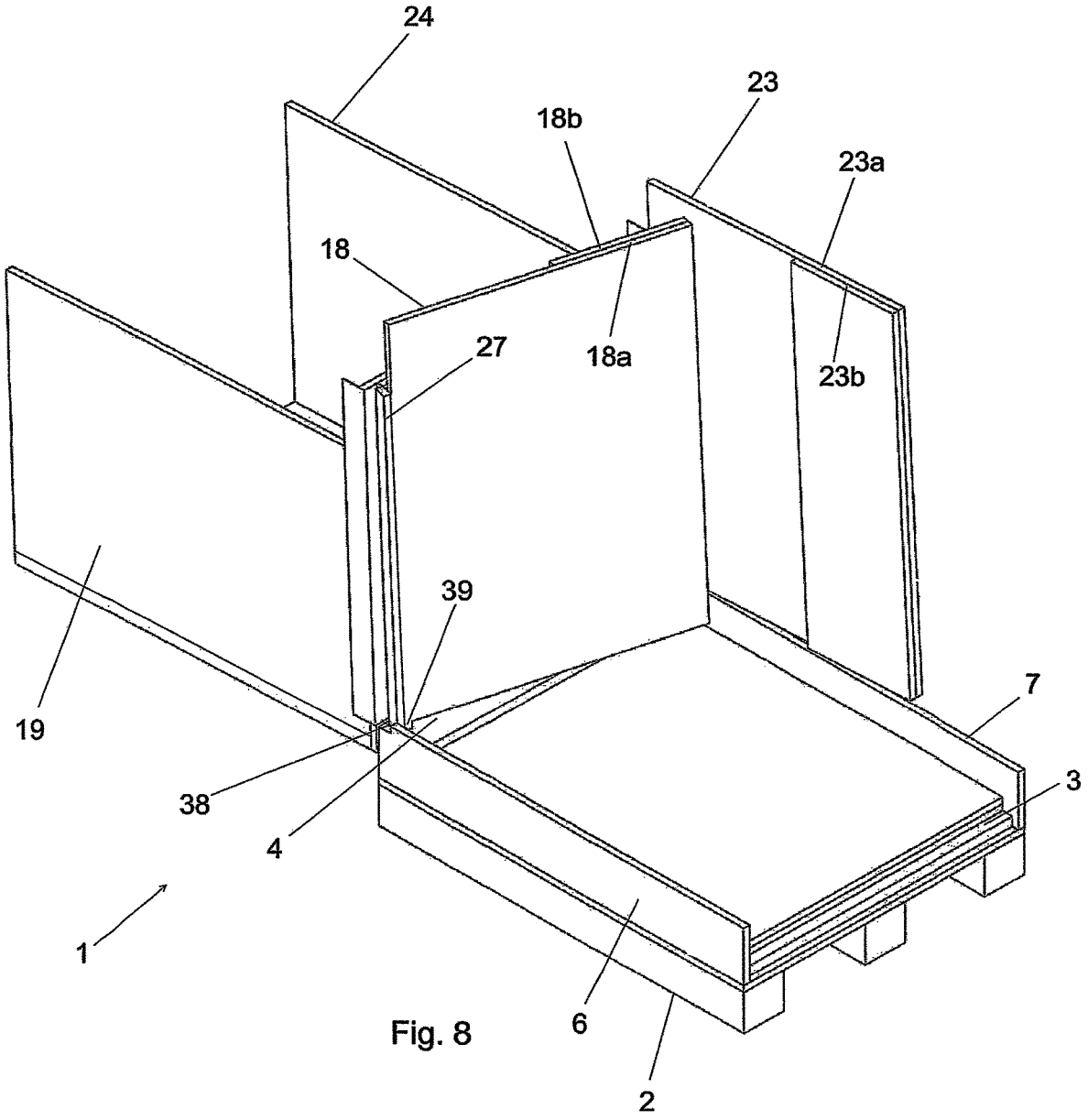
FIG. 8 is a view of the pallet casing assembly of FIG. 1 during a sixth step of a collapsing process.
Figure 9:
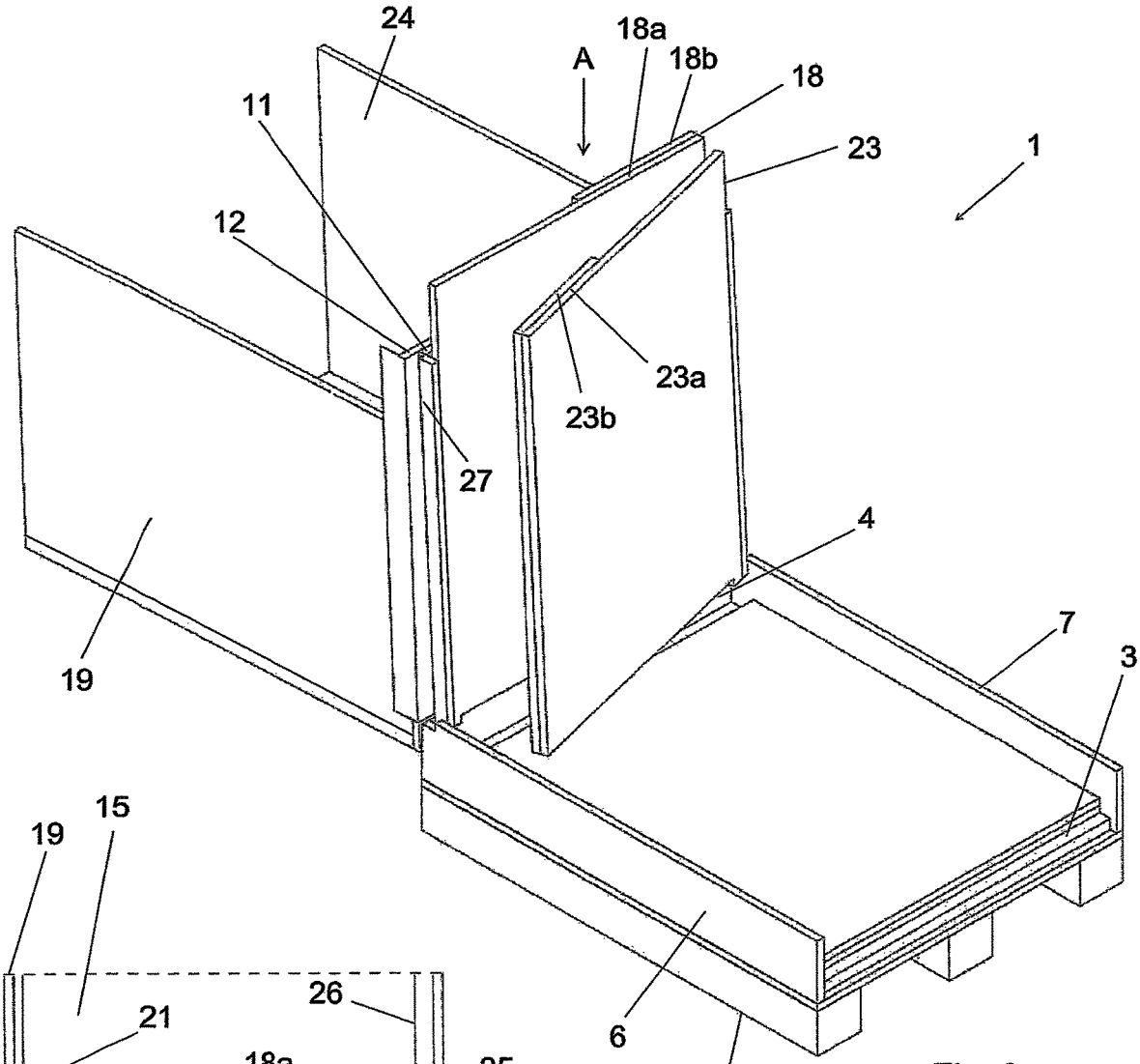
FIG. 9 is a view of the pallet casing assembly of FIG. 1 during a seventh step of a collapsing process.
Figure 10:
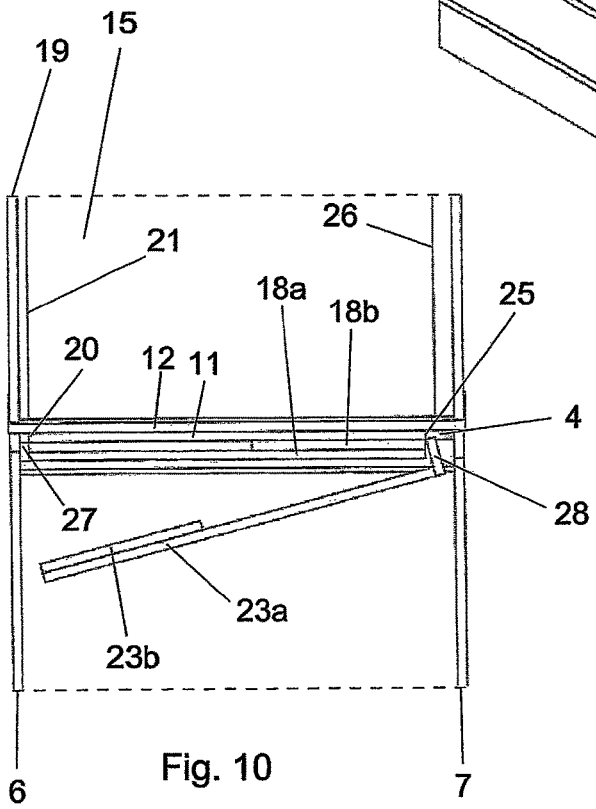
FIG. 10 is a detailed view in the direction "A" in FIG. 9.
Figure 11:
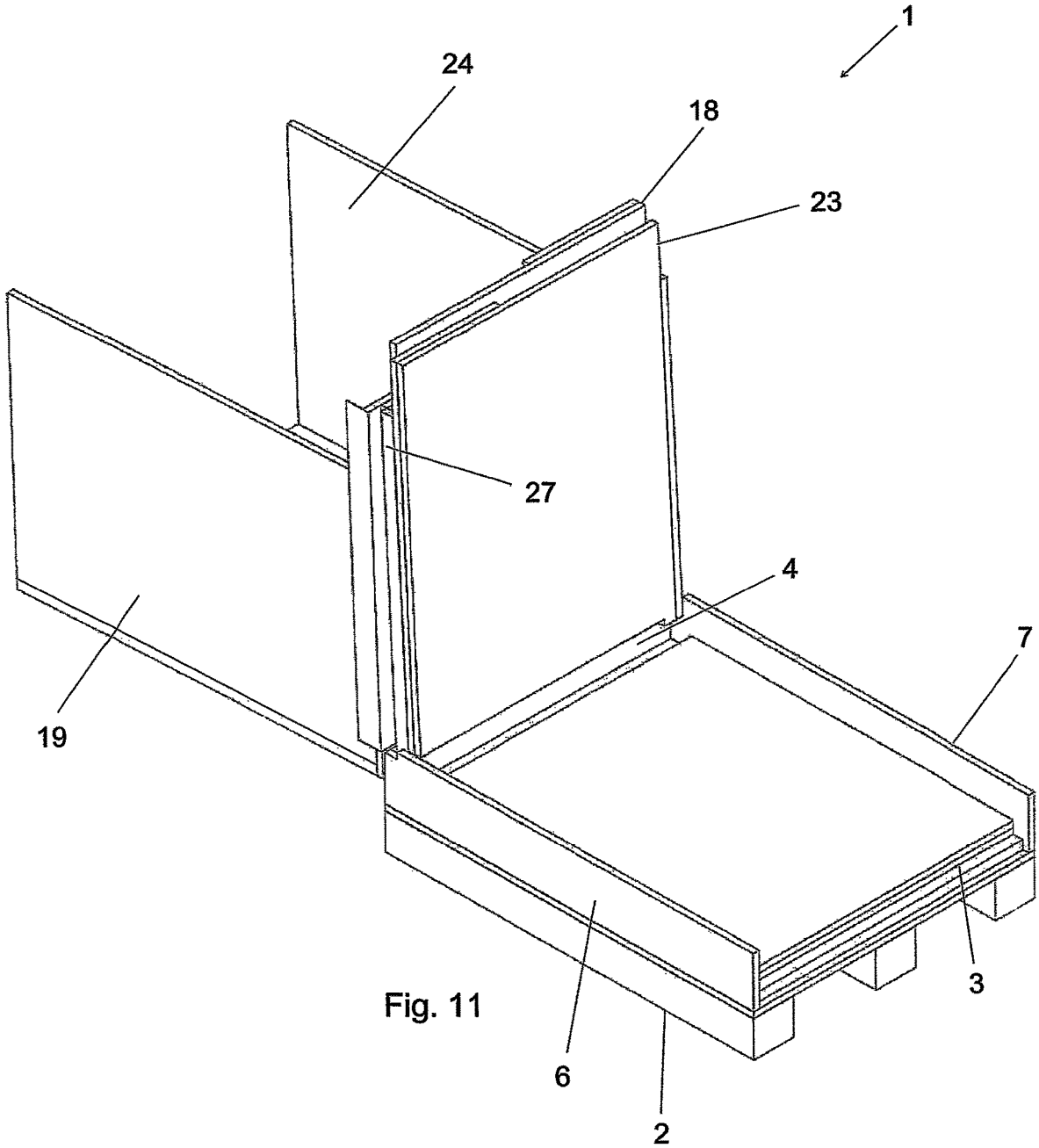
FIG. 11 is a view of the pallet casing assembly of FIG. 1 during an eighth step of a collapsing process.
Figure 12:
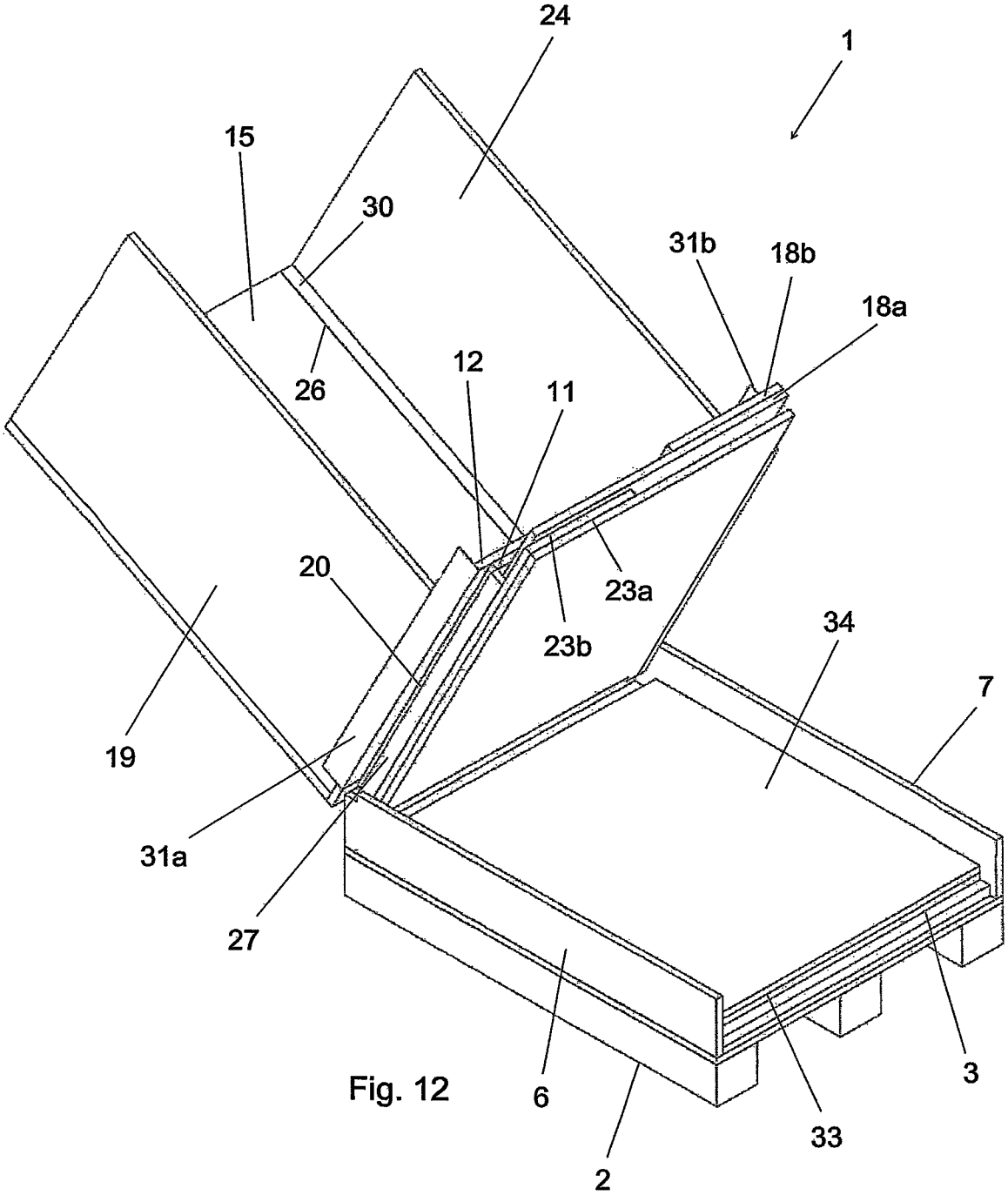
FIG. 12 is a view of the pallet casing assembly of FIG. 1 during a ninth step of a collapsing process.

As is shown in FIG. 7, the upper ends of the first 6 and second 7 lateral frame walls are provided with recesses 38 at the rear ends of these frame walls, close to the rear frame wall 4. The lower ends of the first plate members 18*a*, 23*a* of the lower first 18 and second 23 lateral wall sections are provided with corresponding protrusions 39 at the rear ends of these plate members, which are configured to be inserted and interact by fit locking with said recesses 38 so as to obstruct horizontal pivoting movement of the first plate members 18*a*, 23*a* in the erected state of the pallet casing assembly 1. The locking action of the protrusions 39 in the recesses 38 is released by lifting the lower first 18 and second 23 lateral wall sections so that the protrusions are lifted out of the recesses, whereafter said wall sections 18, 23 may be moved horizontally, i.e. pivotably folded towards each other. The lifting of the lower first 18 and second 23 lateral wall sections is enabled by the design of the hinge arrangements between the first link element 27 and the first lateral end 20 of the lower rear wall section 11 and the second link element 28 and the second lateral end 25 of the lower rear wall section, respectively.

Figure 18:
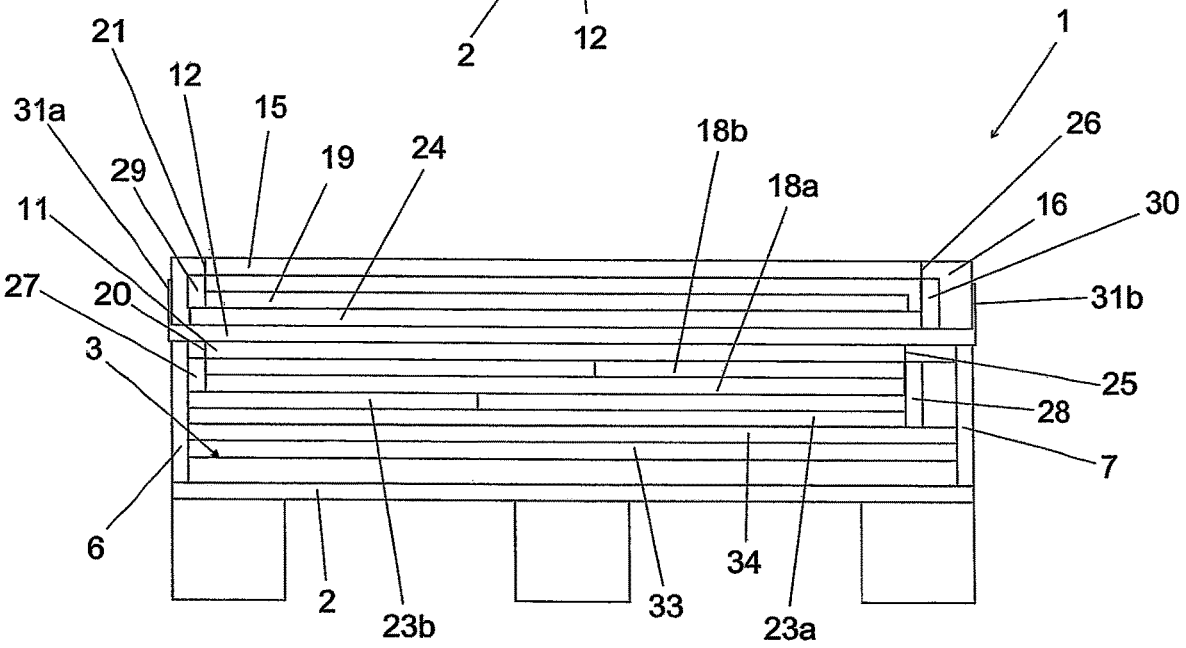
FIG. 18 is a front view of the pallet casing assembly as shown in FIG. 17.

As is seen in FIG. 18, the first link element 27 is configured to hold the first plate member 18*a* of the lower first lateral wall section 18 at a distance to the lower rear wall section 11 corresponding to the thickness of the second plate member 18*b* of the lower first lateral wall section in said collapsed state. More specifically, the first link element 27 is designed and arranged to hold said rear end of the first plate member 18*a* of the lower first lateral wall section 18 at said distance to the lower rear wall section 11 so that said first plate member 18*a* is kept in parallel to the lower rear wall section with the associated second plate member 18*b* sandwiched therebetween in said collapsed state.

The second link element 28 is configured to hold the first plate member 23*a* of the lower second lateral wall section 23 at a distance to the lower rear wall section 11 corresponding to the thicknesses of the second plate member 18*b* of the lower first lateral wall section 18, the first plate member 18*a* of the lower first lateral wall section and the second plate member 23*b* of the lower second lateral wall section 23 combined in said collapsed state. More specifically, the second link element 28 is designed and arranged to hold said rear end of the first plate member 23*a* of the lower second lateral wall section 23 at said distance to the lower rear wall section 11 so that said first plate member 23*a* is kept in parallel to the lower rear wall section with the associated second plate member 23*b* and the first 18*a* and second 18*b* plate members of the lower first lateral wall section sandwiched therebetween in said collapsed state.

The top wall section 15 has a width which is smaller than the distance between the upper first 19 and second 24 lateral wall sections in said erected state, which is seen for instance in FIG. 1. The first lateral end 21 of the top wall section is located at a distance from the upper first lateral wall section 19 in said erected state and the second lateral end 26 of the top wall section is located at a distance from the upper second lateral wall section 24 in said erected state, in the direction from one upper lateral wall section towards the other.

The upper first lateral wall section 19 is hingedly connected at the upper end to the first lateral end 21 of the top wall section 15 by a third link element 29 rigidly connected at a first end to the upper end of the upper first lateral wall section 19 and pivotably connected at an opposite second end to the first lateral end 21 of the top wall section 15. The third link element 29 is configured to extend in a plane in which the top wall section 15 extends in said erected state (see FIG. 1) while forming a right-angled corner with the upper first lateral wall section 19, and to extend perpendicularly away from the top wall section 15 (see FIGS. 16-18) in said collapsed state. The third link element 29 is configured to enable folding (see FIG. 14) of the upper first lateral wall section 19 to a position overlapping and extending in parallel with the top wall section 15 in said collapsed state.

The upper second lateral wall section 24 is hingedly connected at the upper end to the second lateral end 26 of the top wall section 15 by a fourth link element 30 rigidly connected at a first end to the upper end of the upper second lateral wall section 24 and pivotably connected at an opposite second end to the second lateral end 26 of the top wall section 15. The fourth link element 30 is configured to extend in the plane in which the top wall section extends in said erected state (see FIG. 1) while forming a right-angled corner with the upper second lateral wall section 24, and to extend perpendicularly away from the top wall section 15 (see FIGS. 16-18) in said collapsed state. The fourth link element 30 is configured to enable folding (see FIG. 15) of the upper second lateral wall section 24 to a position overlapping and extending in parallel with the upper first lateral wall section 19 in said collapsed state, and to hold the upper second lateral wall section 24 at a distance from the top wall section 15 corresponding to the length of the third link element 29 in said collapsed state.

The link elements described, i.e. the first 27, second 28, third 29 and fourth 30 link elements, are intermediate elements linking/interconnecting the wall sections in question. These elements are in the embodiment shown elongated metal profiles each interconnecting two respective wall sections along entire, or at least a great part of, adjacent outer ends thereof. However, such a link element could also be a smaller element, such as a substantially shorter elongated profile or a lever, interconnecting two wall sections along a small part of or in one spot along adjacent outer ends thereof.

Figure 6:
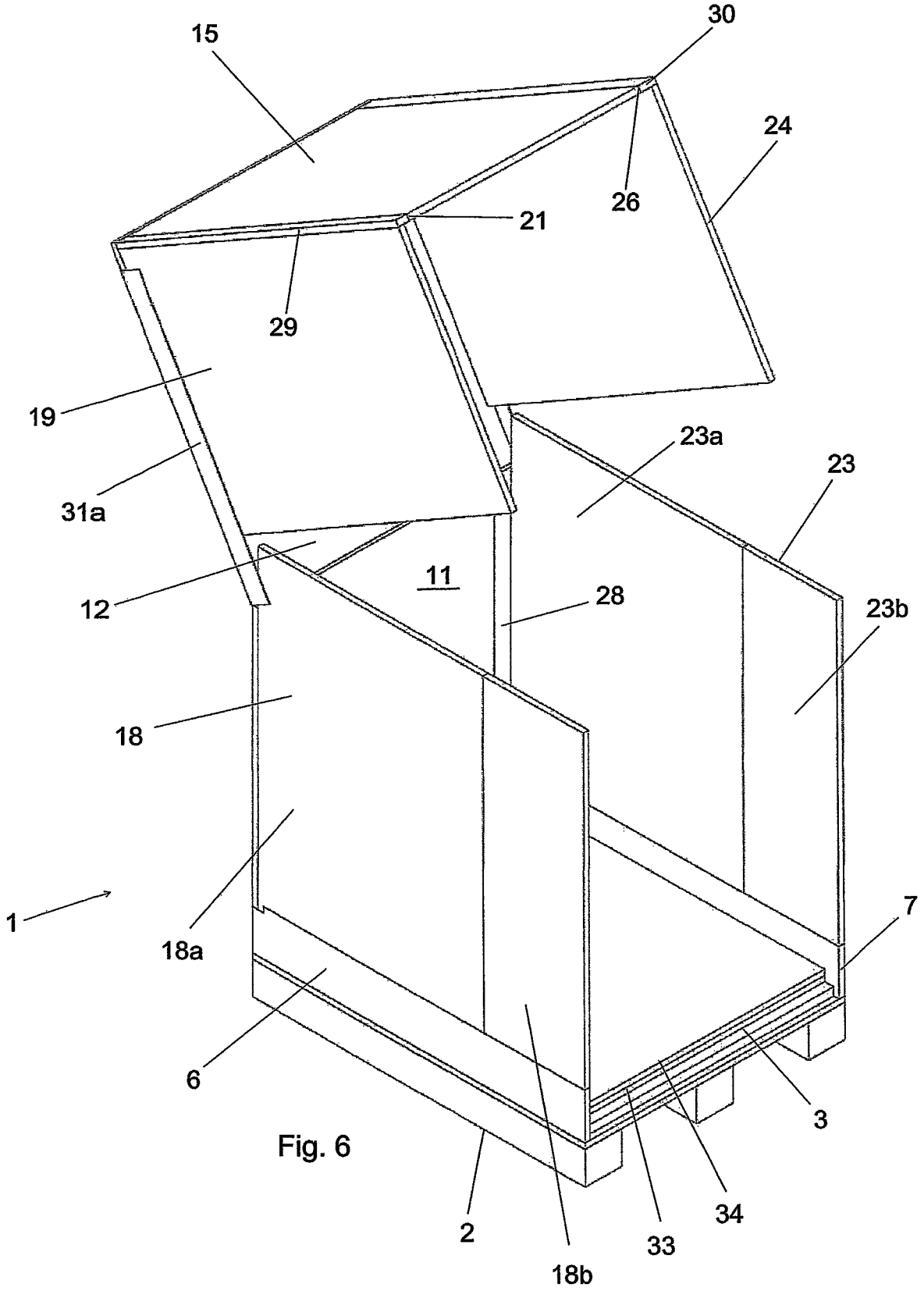
FIG. 6 is a view of the pallet casing assembly of FIG. 1 during a fourth step of a collapsing process.

The lower rear wall section 11 has a height which is lower than the height of the lower first 18 and second 23 lateral wall sections (see for instance FIGS. 2 and 6-7). This simplifies the mounting of the pallet casing assembly 1 as the upper rear ends of the lower first and second lateral wall sections act as stopping surfaces for the upper rear wall section 12 by folding this up onto the lower rear wall section 11 to its position in the erected state (see FIG. 6). This feature also increases the stability of the pallet casing assembly 1 in the erected state, as the weight of the upper first 19 and second 24 lateral wall sections and the top wall section 15 urges the upper rear wall section 12 against said stopping surfaces whereby the upper rear wall section is maintained in a proper position.

The upper rear wall section 12 is provided with a first corner rim 31*a* extending along an entire first lateral edge of the upper rear wall section 12 and protruding perpendicularly therefrom to cover, from the outside, a part of a rear end of the upper first lateral wall section 19 and a part of the rear end of the lower first lateral wall section 18 in said erected state, and a second corner rim 31*b* extending along an entire second lateral edge of the upper rear wall section 12 and protruding perpendicularly therefrom to cover, from the outside, a part of a rear end of the upper second lateral wall section 24 and a part of the rear end of the lower second lateral wall section 23 in said erected state (see FIGS. 1-2). In the embodiment shown, the first 31*a* and second 31*b* corner rims are bent outer portions of a metal sheet 31 covering the entire rear (outer) side of the upper rear wall section 12. However, such corner rims could also be separate parts attached to the upper rear wall section. The corner rims 31*a-b* keep the upper first 19 and second 24 lateral wall sections aligned with the lower first 18 and second 23 lateral wall sections, respectively, which simplifies a mounting step (see FIG. 6) of placing the upper lateral wall sections to rest on the lower lateral wall sections and also increases the stability of the pallet casing assembly 1 in the erected state.

The front casing wall 32 is a separate component configured to be releasably arranged at a front side of the pallet 2 so as to close a front opening into a loading space 13 of the pallet casing assembly 1 in said erected state, and placed in a position on top of the loading surface 3 between this and the lower second lateral wall section 23 (see FIGS. 5 and 12) in said collapsed state. The front opening is defined between front ends of the pallet 2, the first 17 and second 22 lateral casing walls and the top casing wall 14 (see FIG. 3). The front casing wall 32 comprises a lower front wall section 33 and an upper front wall section 34 hingedly connected at a lower end to an upper end of the lower front wall section so as to be foldable to a position overlapping the lower front wall section to be placed on top of or under the lower front wall section between the loading surface 3 and the lower second lateral wall section 23 in said collapsed state. The front casing wall 32 is releasably secured to the second plate members 18*b*, 23*b* of the lower first 18 and second 23 lateral wall sections, the upper first 19 and second 24 lateral wall sections, the top wall section 15 and the pallet 2 in the erected state by securing means 37 suitable for this purpose.

Such securing means may for instance be any type of clips and are schematically shown in FIG. 1.

Hereinafter, a process of transferring the pallet casing assembly 1 from the erected state to the collapsed state is to be described.

Figure 5:
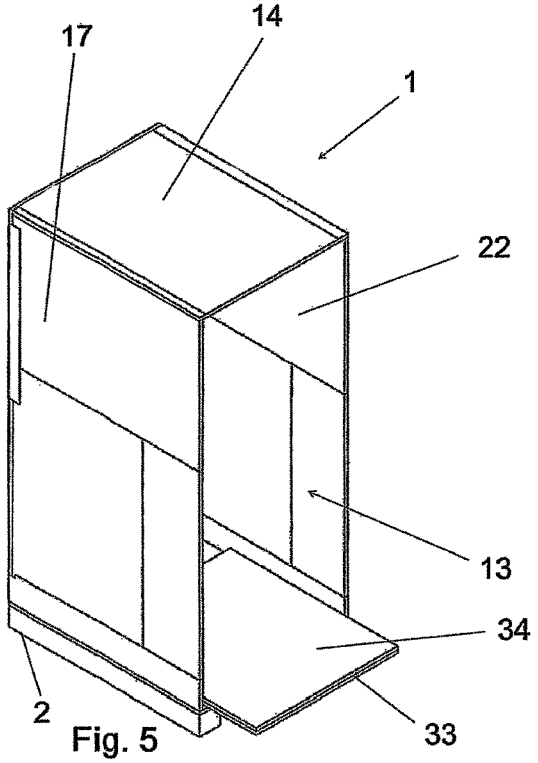
FIG. 5 is a view of the pallet casing assembly of FIG. 1 during a third step of a collapsing process.

Firstly, the front casing wall 32 is removed (see FIG. 3) by releasing the securing means 37, folded (see FIG. 4) and placed on the loading surface 3 (see FIG. 5). The securing means 35 on the lateral casing walls 17, 18 are then released allowing the upper rear wall section 12 (together with the top wall section 15 and the upper first 19 and second 24 lateral wall sections) to be folded backwards (see FIG. 6) to a position overlapping and abutting the lower rear wall section 11 (see FIG. 7). The second plate members 18*b*, 23*b* are folded to a position overlapping the respective first plate members 18*a*, 23*a* of the lower first 18 and second 23 lateral wall sections (see FIG. 7).

Then, the lower first lateral wall section 18 is lifted, so that the protrusion 39 thereof comes out of its locking position in the recess 38 of the first lateral frame wall 6, and folded towards the lower rear wall section 11 (see FIG. 8) while the first link element 27 displaces the rear end of the first plate member 18*a* of this lateral wall section 18 from the first lateral frame wall 6 towards the second lateral frame wall 7 so that the entire lower first lateral wall section 18 is placed in a position between the first 6 and second 7 lateral frame walls (see FIGS. 9-10), in which it overlaps the lower rear wall section 11 and the second plate member 18*b* abuts this section 11. The lower second lateral wall section 23 is then lifted and folded in the same way (see FIGS. 9-10) towards the lower rear wall section 11 while the second link element 28 displaces the rear end of the first plate member 23*a* of this lateral wall section 23 from the second lateral frame wall 7 towards the first lateral frame wall 6 so that the entire lower second lateral wall section 23 is placed in a position between the first 6 and second 7 lateral frame walls (see FIG. 11), in which it overlaps the lower first lateral wall section 18 and the second plate member 23*b* of the lower second lateral wall section 23 abuts the first plate member 18*a* of the lower first lateral wall section 18.

Figure 13:
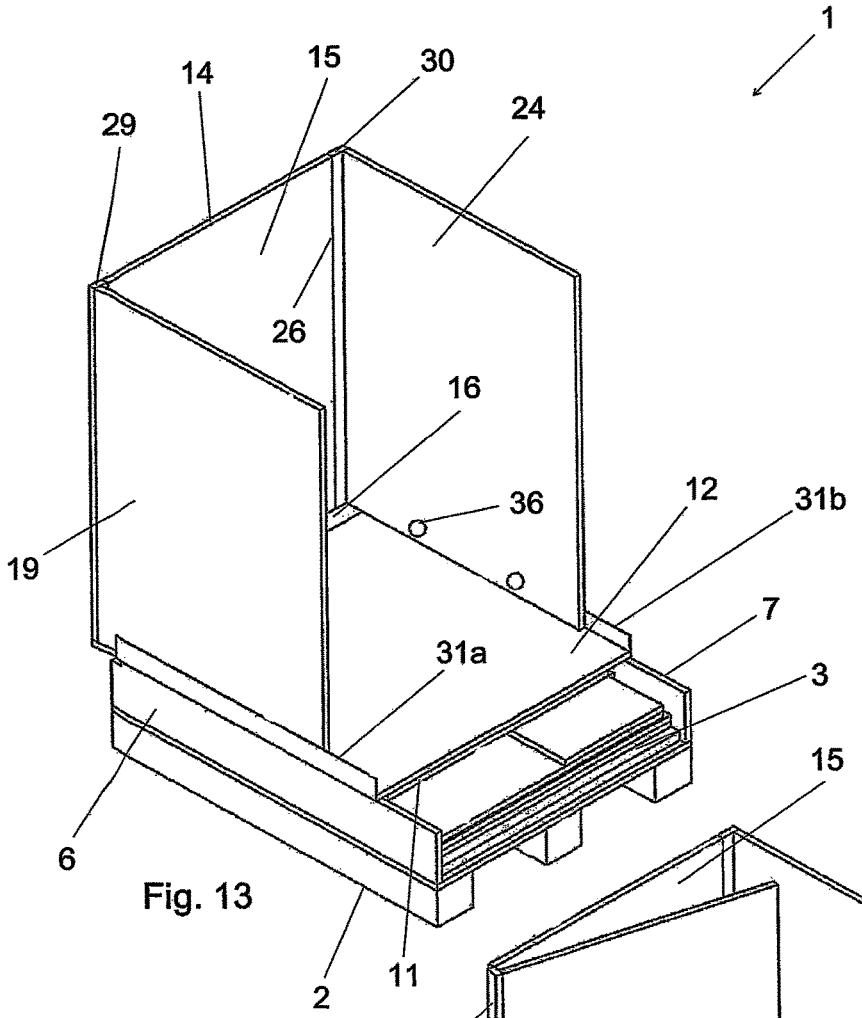
FIG. 13 is a view of the pallet casing assembly of FIG. 1 during a tenth step of a collapsing process.
Figure 14:
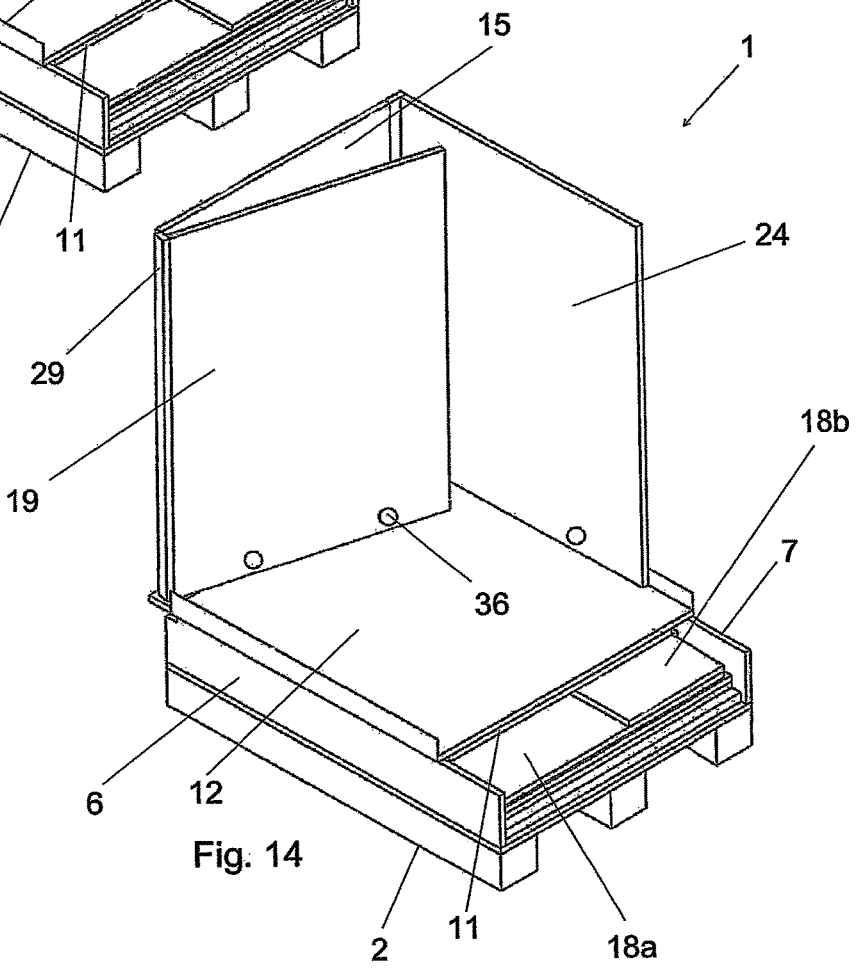
FIG. 14 is a view of the pallet casing assembly of FIG. 1 during an eleventh step of a collapsing process.
Figure 15:
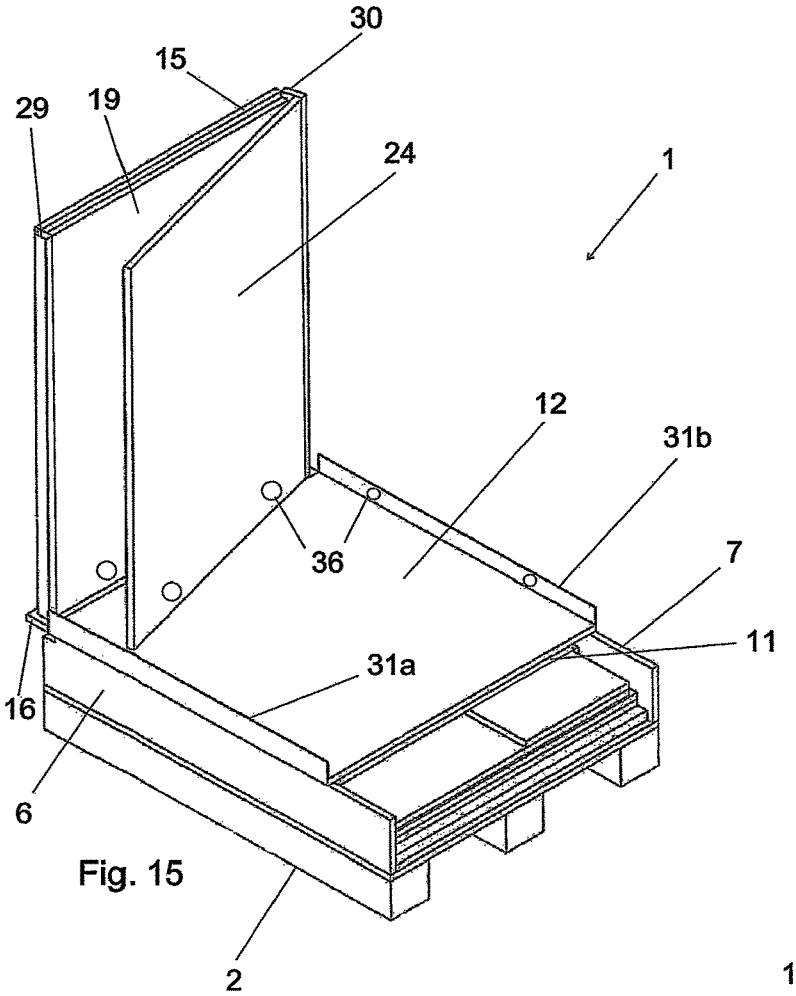
FIG. 15 is a view of the pallet casing assembly of FIG. 1 during a twelfth step of a collapsing process.
Figure 16:
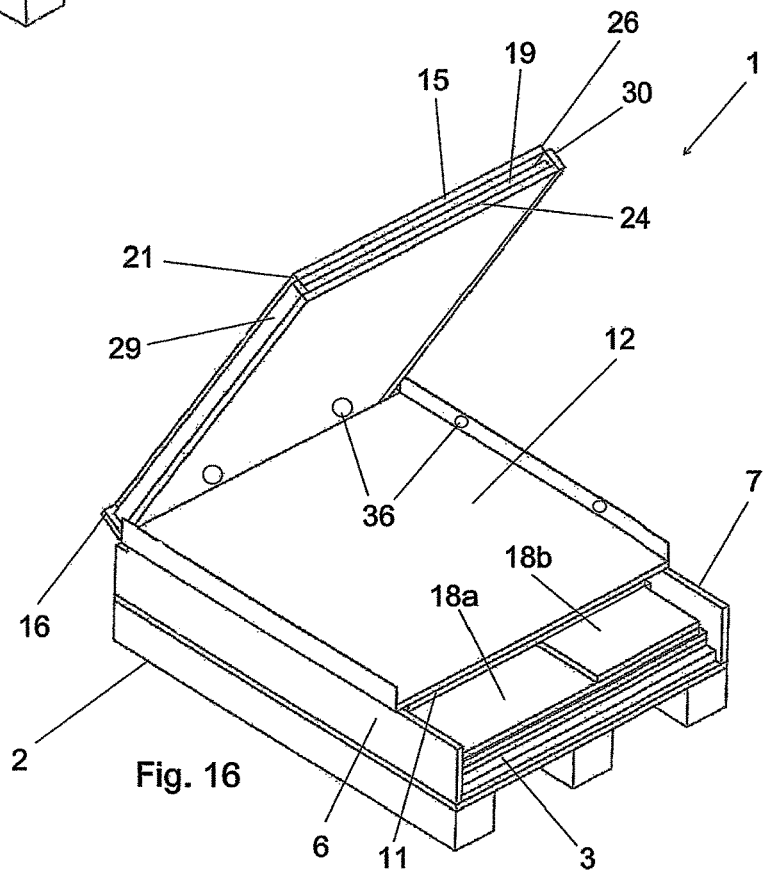
FIG. 16 is a view of the pallet casing assembly of FIG. 1 during a thirteenth step of a collapsing process.

In a next step, the lower rear wall section 11 is folded down towards the loading surface 3 (see FIG. 12) so that the lower second lateral wall section 23 is placed on top of the front wall section 32, the lower first lateral wall section 18 is placed on top of the lower second lateral wall section 23, the lower rear wall section 11 is placed on top of the lower first lateral wall section 18 and the upper rear wall section 12 is placed on top of the lower rear wall section 11 (see FIG. 13). Accordingly, all said sections 11, 12, 18, 23, 32 are received between the first 6 and second 7 lateral frame walls on top of the loading surface 3 of the pallet 2, which reduces the height of the pallet casing assembly in the collapsed state.

Then, the securing means 36 locking the upper first 19 and second 24 lateral wall sections to the upper rear wall section 12 are released and the upper first lateral wall section 19 is folded towards the top wall section 15 (see FIG. 14) to a position overlapping this section, whereafter the upper second lateral wall section 24 is folded towards the top wall section 15 (see FIG. 15) to a position overlapping and abutting the upper first lateral wall section 19.

Figure 17:
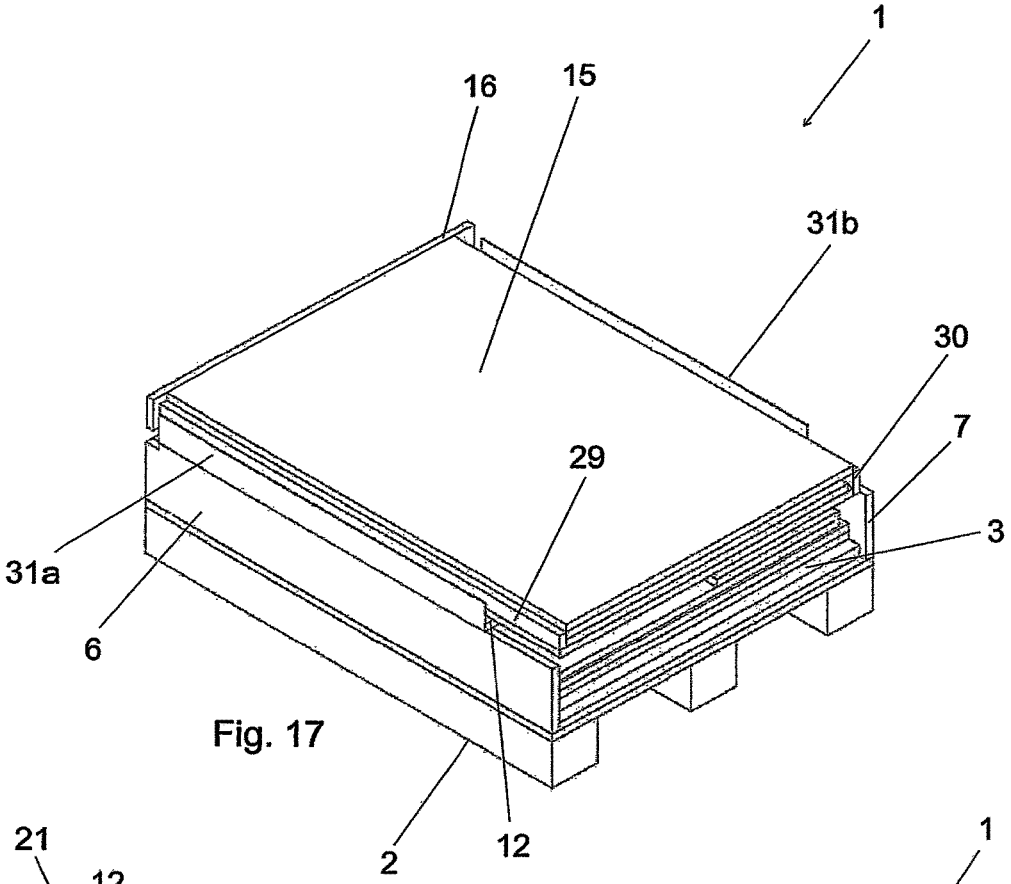
FIG. 17 is a perspective view obliquely from the front of the pallet casing assembly of FIG. 1, in the collapsed state.

Lastly, the top wall section 15 is folded down towards the loading surface 3 (see FIG. 16) so that the upper second lateral wall section 24 is placed on top of the upper rear wall section 12, the upper first lateral wall section 19 is placed on top of the upper second lateral wall section 24 and the top wall section 15 is placed on top of the upper first lateral wall section 19, all said sections received between the first 31*a* and second 31*b* corner rims of the upper rear wall section 12, and the pallet casing assembly 1 is in the collapsed state (see FIGS. 17-18).

Needless to say, the process of transferring the pallet casing assembly 1 from the collapsed state to the erected state is the same as that described above, but in reverse order (see FIGS. 18 to 1).

As is seen in FIG. 18, all wall sections are parallel to each other in the collapsed state which makes the pallet casing assembly very compact and strong in this state, allowing stacking of several pallet casing assemblies on top of each other. Furthermore, the wall sections are protected on the rear and lateral sides by the frame walls 4, 6, 7, corner rims 31*a-b* and the rear edge rim 16 in the collapsed state, increasing the durability of the pallet casing assembly 1.

Hence, a pallet casing assembly 1 is provided, which is transferable between an erected state, in which it has a large loading space 13 enclosed by a strong protective casing suitable for the shipping of server racks, and a collapsed state in which it may be stored or transported as a compact unit claiming little space. The pallet casing assembly may have a height of more than 2.0 meters, preferably between 2.0 and 2.5 meters, in the erected state, and a height lower than 0.5 meters in the collapsed state. This is made possible by the inventive foldable design of the pallet casing assembly 1, and especially by the use of said link elements 27-30.

The invention is of course not in any way restricted to the embodiment thereof described above, but many possibilities to modifications thereof will be apparent to a person with ordinary skill in the art without departing from the scope of the invention as defined in the appended claims.

Where it is stated that a component is "connected to" another component, this is to be interpreted as that the components are interconnected directly, or indirectly by an intermediate component, such as an edge profile or another connecting element.

A component being "hingedly/pivotably connected to" another component means that there is some type of hinge arrangement directly or indirectly interconnecting these components. Such hinge arrangements are not shown in the drawings, and may be hinge arrangements of any suitable type, such as piano hinges or hinges made by a piece of flexible material. The pallet casing assembly may comprise such hinge arrangements of several different types.

The wall sections of the casing walls, including the plate members of the lower lateral wall sections, may be made of any sheet material, such as wood, metal or plastic, and may also comprise several different materials. Furthermore, one or more wall sections may have holes, such as have a net-structure or the like.

A pallet casing assembly is in this disclosure to be interpreted as a pallet provided with a box-like structure defining a space suitable for accommodating objects to be stored or transported on the pallet.

The terms upper, lower, front, rear, horizontal and vertical as are used in this disclosure for defining various components, or parts thereof, are to be interpreted as valid for a pallet casing assembly placed on a horizontal ground, as shown for instance in FIG. 1. The front of the pallet casing assembly as shown in FIG. 1 is directed obliquely to the right and obliquely towards the viewer of the drawing.

The invention claimed is:

1. A collapsible pallet casing assembly (1) configured to be used as a shipping crate for bulky objects, comprising:

a pallet (2) provided with an upper loading surface (3) configured to form a bottom of the pallet casing assembly (1) in an erected state thereof and further provided with a frame structure enclosing the loading surface (3) on a rear side and lateral sides thereof by a vertical rear frame wall (4) and vertical first (6) and second (7) lateral frame walls at a rear edge (5) and first (8) and second (9) opposite lateral edges of the pallet (2), respectively, a rear casing wall (10) comprising a lower rear wall section (11) hingedly connected at a lower end to the rear frame wall (4) to be foldable to a position on top of the loading surface (3) in a collapsed state of the pallet casing assembly (1), and an upper rear wall section (12) hingedly connected to an upper end of said lower rear wall section (11) to be foldable to a position on top of the lower rear wall section (11) in said collapsed state, a top casing wall (14) comprising a top wall section (15) hingedly connected at a rear end to an upper end of the upper rear wall section (12) to be foldable to a position on top of the upper rear wall section (12) in said collapsed state, a first lateral casing wall (17) comprising a lower first lateral wall section (18) configured to rest on the first lateral frame wall (6) in said erected state and hingedly connected at a rear end to a first lateral end (20) of the lower rear wall section (11) to be foldable to a position overlapping the lower rear wall section (11) to be placed between the lower rear wall section (11) and the loading surface (3) in said collapsed state, and an upper first lateral wall section (19) configured to rest on an upper end of the lower first lateral wall section (18) in said erected state and hingedly connected at an upper end to a first lateral end (21) of the top wall section (15) to be foldable to a position overlapping the top wall section (15) to be placed between the top wall section (15) and the upper rear wall section (12) in said collapsed state, a second lateral casing wall (22) comprising a lower second lateral wall section (23) configured to rest on the second lateral frame wall (7) in said erected state and hingedly connected at a rear end to a second lateral end (25) of the lower rear wall section (11) to be foldable to a position overlapping the lower first lateral wall section (18) to be placed between the lower first lateral wall section (18) and the loading surface (3) in said collapsed state, and an upper second lateral wall section (24) configured to rest on an upper end of the lower second lateral wall section (23) in said erected state and hingedly connected at an upper end to a second lateral end (26) of the top wall section (15) to be foldable to a position overlapping the upper first lateral wall section (19) to be placed between the upper first lateral wall section (19) and the upper rear wall section (12) in said collapsed state, wherein the lower rear wall section (11) has a width which is smaller than the distance between the first (6) and second (7) lateral frame walls, the first lateral end (20) of the lower rear wall section (11) is located at a distance from the first lateral frame wall (6) in said erected state, the second lateral end (25) of the lower rear wall section (11) is located at a distance from the second lateral frame wall (7) in said erected state, the lower first lateral wall section (18) is hingedly connected to the first lateral end (20) of the lower rear wall section (11) by a first link element (27) connected at a first end to the rear end of the lower first lateral wall section (18) and pivotably connected at an opposite second end to the first lateral end (20) of the lower rear wall section (11), and the lower second lateral wall section (23) is hingedly connected to the second lateral end (25) of the lower rear wall section (11) by a second link element (28) connected at a first end to the rear end of the lower second lateral wall section (23) and pivotably connected at an opposite second end to the second lateral end (25) of the lower rear wall section (11).

2. A pallet casing assembly (1) according to claim 1, wherein the lower first lateral wall section (18) comprises at least two plate members (18*a-b*) together constituting this wall section (18), a first plate member (18*a*) is hingedly connected at a rear end to the lower rear wall section (11) by the first link element (27), a second plate member (18*b*) is hingedly connected at a rear end to a front end of this first plate member (18*a*) to be foldable to a position overlapping this first plate member (18*a*) to be placed between this first plate member (18*a*) of the lower first lateral wall section (18) and the lower rear wall section (11) in said collapsed state, the lower second lateral wall section (23) comprises at least two plate members (23*a-b*) together constituting this wall section (23), a first plate member (23*a*) is hingedly connected at a rear end to the lower rear wall section (11) by the second link element (28), and a second plate member (23*b*) is hingedly connected at a rear end to a front end of this first plate member (23*a*) so as to be foldable to a position overlapping this first plate member (23*a*) to be placed between this first plate member (23*a*) of the lower second lateral wall section (23) and the first plate member (18*a*) of the lower first lateral wall section (18) in said collapsed state.

3. A pallet casing assembly (1) according to claim 2, wherein the first link element (27) is configured to extend in a plane in which the lower rear wall section (11) extends in said erected state to form a right-angled corner with the lower first lateral wall section (18) in said erected state, and extend perpendicularly away from the lower rear wall section (11) in said collapsed state, and the second link element (28) is configured to extend in the plane in which the lower rear wall section (11) extends in said erected state to form a right-angled corner with the lower second lateral wall section (23) in said erected state, and extend perpendicularly away from the lower rear wall section (11) in said collapsed state.

4. A pallet casing assembly (1) according to claim 2, wherein the first link element (27) is configured to hold the first plate member (18*a*) of the lower first lateral wall section (18) at a distance to the lower rear wall section (11) corresponding to the thickness of the second plate member (18*b*) of the lower first lateral wall section (18) in said collapsed state.

5. A pallet casing assembly (1) according to claim 4, wherein the first link element (27) is configured to extend in a plane in which the lower rear wall section (11) extends in said erected state to form a right-angled corner with the lower first lateral wall section (18) in said erected state, and extend perpendicularly away from the lower rear wall section (11) in said collapsed state, and the second link element (28) is configured to extend in the plane in which the lower rear wall section (11) extends in said erected state to form a right-angled corner with the lower second lateral wall section (23) in said erected state, and extend perpendicularly away from the lower rear wall section (11) in said collapsed state.

6. A pallet casing assembly (1) according to claim 5, wherein the first link element (27) is rigidly connected at the first end thereof to the rear end of the lower first lateral wall section (18) and the second link element (28) is rigidly connected at the first end thereof to the rear end of the lower second lateral wall section (23).

7. A pallet casing assembly (1) according to claim 4, wherein second link element (28) is configured to hold the first plate member (23*a*) of the lower second lateral wall section (23) at a distance to the lower rear wall section (11) corresponding to the thicknesses of the second plate member (18*b*) of the lower first lateral wall section (18), the first plate member (18*a*) of the lower first lateral wall section (18) and the second plate member (23*b*) of the lower second lateral wall section (23) combined in said collapsed state.

8. A pallet casing assembly (1) according to claim 7, wherein the first link element (27) is configured to extend in a plane in which the lower rear wall section (11) extends in said erected state to form a right-angled corner with the lower first lateral wall section (18) in said erected state, and extend perpendicularly away from the lower rear wall section (11) in said collapsed state, and the second link element (28) is configured to extend in the plane in which the lower rear wall section (11) extends in said erected state to form a right-angled corner with the lower second lateral wall section (23) in said erected state, and extend perpendicularly away from the lower rear wall section (11) in said collapsed state.

9. A pallet casing assembly (1) according to claim 8, wherein the first link element (27) is rigidly connected at the first end thereof to the rear end of the lower first lateral wall section (18) and the second link element (28) is rigidly connected at the first end thereof to the rear end of the lower second lateral wall section (23).

10. A pallet casing assembly (1) according to claim 1, wherein the first link element (27) is configured to extend in a plane in which the lower rear wall section (11) extends in said erected state to form a right-angled corner with the lower first lateral wall section (18) in said erected state, and extend perpendicularly away from the lower rear wall section (11) in said collapsed state, and the second link element (28) is configured to extend in the plane in which the lower rear wall section (11) extends in said erected state to form a right-angled corner with the lower second lateral wall section (23) in said erected state, and extend perpendicularly away from the lower rear wall section (11) in said collapsed state.

11. A pallet casing assembly (1) according to claim 1, wherein the first link element (27) is rigidly connected at the first end thereof to the rear end of the lower first lateral wall section (18) and the second link element (28) is rigidly connected at the first end thereof to the rear end of the lower second lateral wall section (23).

12. A pallet casing assembly (1) according to claim 1, wherein the lower rear wall section (11) has a height which is lower than the height of the lower first (18) and second (23) lateral wall sections, and the upper rear wall section (12) is provided with a first corner rim (31*a*) extending from a first lateral edge of the upper rear wall section (12) to cover, from the outside, at least a part of a rear end of the upper first lateral wall section (19) and a part of the rear end of the lower first lateral wall section (18) in said erected state, and a second corner rim (31*b*) extending from a second lateral edge of the upper rear wall section (12) to cover, from the outside, at least a part of a rear end of the upper second lateral wall section (24) and a part of the rear end of the lower second lateral wall section (23) in said erected state.

13. A pallet casing assembly (1) according to claim 1, wherein the upper first lateral wall section (19) is hingedly connected at the upper end to the first lateral end (21) of the top wall section (15) by a third link element (29) connected at a first end to the upper end of the upper first lateral wall section (19) and pivotably connected at an opposite second end to the first lateral end (21) of the top wall section (15), and the third link element (29) is configured to enable folding of the upper first lateral wall section (19) to a position overlapping and extending in parallel with the top wall section (15) in said collapsed state.

14. A pallet casing assembly (1) according to claim 13, wherein the upper second lateral wall section (24) is hingedly connected at the upper end to the second lateral end (26) of the top wall section (15) by a fourth link element (30) connected at a first end to the upper end of the upper second lateral wall section (24) and pivotably connected at an opposite second end to the second lateral end (26) of the top wall section (15), and the fourth link element (30) is configured to enable folding of the upper second lateral wall section (24) to a position overlapping and extending in parallel with the upper first lateral wall section (19) in said collapsed state, and to hold the upper second lateral wall section (24) at a distance from the top wall section (15) corresponding to the length of the third link element (29) in said collapsed state.

15. A pallet casing assembly (1) according to claim 14, wherein the third link element (29) is configured to extend in a plane in which the top wall section (15) extends in said erected state and form a right-angled corner with the upper first lateral wall section (19) in said erected state, and extend perpendicularly away from the top wall section (15) in said collapsed state, and the fourth link element (30) is configured to extend in the plane in which the top wall section (15) extends in said erected state and form a right-angled corner with the upper second lateral wall section (24) in said erected state, and extend perpendicularly away from the top wall section (15) in said collapsed state.

16. A pallet casing assembly (1) according to claim 14, wherein the third link element (29) is rigidly connected at the first end thereof to the upper end of the upper first lateral wall section (19), the fourth link element (30) is rigidly connected at the first end thereof to the upper end of the upper second lateral wall section (24).

17. A pallet casing assembly (1) according to claim 1, wherein the assembly further comprises:

a front casing wall (32) configured to be releasably arranged at a front side of the pallet (2) to close a front opening into a loading space (13) of the pallet casing assembly (1) in said erected state, and placed in a position on top of the loading surface (3) between this and the lower second lateral wall section (23) in said collapsed state.

18. A pallet casing assembly (1) according to claim 17, wherein the front casing wall (32) comprises a lower front wall section (33) and an upper front wall section (34) hingedly connected at a lower end to an upper end of the lower front wall section (33) to be foldable to a position overlapping the lower front wall section (33) to be placed on top of or under the lower front wall section (33) between the loading surface (3) and the lower second lateral wall section (23) in said collapsed state.

19. A pallet casing assembly (1) according to claim 1, wherein the pallet casing assembly (1) has a height of at least 1.5 meters, preferably between 2.0 and 2.5 meters, in said erected state, and a height lower than 0.5 meters in said collapsed state.

* * * * *